US007145064B2

(12) United States Patent
Geiger

(10) Patent No.: US 7,145,064 B2
(45) Date of Patent: Dec. 5, 2006

(54) ACOUSTIC AMPLIFIER AND TONE CONTROLLER FOR STRINGED MUSICAL INSTRUMENTS

(76) Inventor: John F. Geiger, 190 Berwick Dr., NE., Atlanta, GA (US) 30328

( * ) Notice: Subject to any disclaimer, the term of this patent is extended or adjusted under 35 U.S.C. 154(b) by 0 days.

(21) Appl. No.: 11/267,750

(22) Filed: Nov. 4, 2005

(65) Prior Publication Data

US 2006/0048625 A1 Mar. 9, 2006

Related U.S. Application Data

(63) Continuation-in-part of application No. 10/459,961, filed on Jun. 12, 2003, now Pat. No. 6,861,581.

(60) Provisional application No. 60/700,104, filed on Jul. 19, 2005.

(51) Int. Cl.
*G10D 3/02* (2006.01)

(52) U.S. Cl. ..... 84/294

(58) Field of Classification Search ..... 84/294–296, 84/267, 270

See application file for complete search history.

(56) References Cited

U.S. PATENT DOCUMENTS

2002/0043146 A1* 4/2002 McPherson ..... 84/291
2003/0167901 A1* 9/2003 Lalonde ..... 84/453

* cited by examiner

*Primary Examiner*—Kimberly Lockett
(74) *Attorney, Agent, or Firm*—Harry I. Leon; Vivian L. Steadman

(57) ABSTRACT

A sound enhancing device for F-hole stringed instruments, banjos, and drums. The device includes at least one cross-shaped element and a timbre square, which may be part of a larger, user-constructed sound emitter. Strung like beads along a fastener, one or more cross-shaped elements and timbre squares are arrayed between a bridge and terminal retainer. In one embodiment, the cross-shaped element and timbre square are juxtaposed, forming a sound emitter which is mounted within an F-hole instrument's sound chamber; the bridge, positioned above it and astraddle opposing F-hole side edges, collects inaudible sound surface waves and transmits them through the fastener —a knot-free, waxed string under tension—to the sound emitter. There sound waves are amplified by constructive interference, timbre characteristics added, and sound waves transferred into the sound chamber's air. The latter then increase the sound surface waves at the F-hole's edges, setting up a positive feedback loop.

14 Claims, 5 Drawing Sheets

ACOUSTIC AMPLIFIER AND TONE CONTROLLER FOR STRINGED MUSICAL INSTRUMENTS

CROSS REFERENCE TO RELATED APPLICATIONS

This application is both a continuation in part of application Ser. No. 10/459,961, filed Jun. 12, 2003, now U.S. Pat. No. 6,861,581 and a non-provisional application of the earlier filed provisional application Ser. No. 60/700,104 filed Jul. 19, 2005, and claims the benefit of the priority date of the filing date Jul. 19, 2005, pursuant to U.S.C. Sec. 119(e).

FIELD OF INVENTION

This present invention relates generally to F-hole guitars, F-hole mandolins, and other stringed instruments having elongated sound openings, as well as to banjos and openable drums, and in particular to devices for enriching and amplifying the output sound of such instruments without the use of electronics.

BACKGROUND OF THE INVENTION

The volume, sound duration and richness of tone needed to create beautiful music with today's acoustic stringed instruments is difficult, at best, to achieve. The problem stems in large part from the fact that few adjustments can be made to change the sound characteristics of these instruments once they have been manufactured. An added handicap for small guitars, mandolins and acoustic-electric guitars is the small size of their sound chambers which tends to hinder the production of musical notes of low frequency.

Traditionally, success in making good sounding acoustic guitars, acoustic-electric guitars, mandolins, banjos and drums was largely determined by the quality of the materials used in construction, the quality of skilled craftsmanship in the manufacturing process, and a degree of good fortune as the various parts were brought together and the instrument was tested, primarily after completion. The intricacies of this approach insured that good sounding acoustic instruments made following its techniques would be expensive.

Further, tuning guitars and mandolins for optimum performance (defined herein as a state in which they exhibit a noticeable maximum available volume with a noticeably high quality of sound) was left up to the manufacturer. Banjos and drums, while tuneable for optimum performance to a degree, required the expenditure of considerable effort on the part of experienced players.

Players have had so little control over the characteristic sound or timbre (hereinafter "timbre") of their acoustic stringed instruments that musicians often resorted to using several instruments to meet their needs for different sounds.

Not until recently has this situation improved significantly and only with respect to round-hole acoustic musical instruments. As described by Geiger in U.S. Pat. No. 6,861,581, a resonating and amplifying device, capable of improving the sound quality and volume of a conventional guitar, includes a cross-shaped resonator which when mounted within the guitar's sound chamber is cantilevered beneath its sound hole, partially covering it. Holding the device in position is a set of prongs formed in an extended arm of the resonator. In use, opposing upper and under prongs clip the device to the edge of the sound hole which then forms a wedge between them, Unfortunately, the geometry of this device is such that it cannot be readily attached to the edge of elongated sound openings such as are found in F-hole guitars, F-hole mandolins, and the like. Moreover, in placing the resonator on a guitar, one risks harming its body unless the prongs are handled gently.

SUMMARY OF INVENTION

The object of the present invention is to provide a mechanical device capable of increasing the volume, sound duration and richness of tone of all musical notes, the device being readily attachable to and removable from a wide variety of conventional musical instruments including those with F-holes and similar elongated sound openings, as well as banjos, drums and the like.

A further object is to provide such a mechanical device which the player of a musical instrument can use to easily change temporarily and significantly its volume, sound duration, and timbre.

A still further object is to provide such a mechanical device which a player can easily use to "tune" an acoustic instrument for optimum performance.

A still further object is to provide such a mechanical device which not only can be easily attached to and removed from a musical instrument without damaging it but also can be fabricated by unskilled craftsmen from common inexpensive materials, making good musical sound available from less expensive instruments and therefore available to more people.

In accordance with the present invention, there is provided an improved sound enhancing device which includes a sound emitter, an elongated fastener, and a bridge. The sound emitter comprises a stacked array having at least two nested cross-shaped elements and a timbre square, each of which is small and thin in shape and defines a central hole sized for slideably receiving the fastener. Aligned with the cross-shaped elements and the timbre square along the elongated fastener, the bridge contacts the body of the musical instrument itself, collecting inaudible sound surface waves thereon and transmitting them through the fastener to the sound emitter. The latter is mounted within the instrument's sound chamber.

The bridge, on the other hand, is mounted outside of the sound chamber whenever the device is used to enhance the performance of F-hole instruments and the like. Preferably formed as a wooden half-ball which has a generally flat bottom and defines a reverse-tapered hole extending perpendicularly thereto, the bridge is sized to straddle the instrument's elongated sound opening.

In use, opposing edges of the sound opening are wedged between the bridge's flat bottom and the sound emitter. Holding them together in assembled relation is the fastener which, in the preferred embodiment, includes a waxed, knot-free string, a retainer ring, and a tapered pin. The pin fits tightly in the smallest transverse cross-section of the reverse-tapered hole and, when so fitted, does not protrude from the bridge's flat bottom. The waxed string, which is doubled upon itself except where it contacts the retaining ring, passes through both the reverse-tapered hole and the central hole of each of the cross-shaped elements. Seated in the reverse-tapered hole, the pin is used to hold a length of the doubled waxed string securely against the hole's upper edge at the top of the half-ball once the string has been pulled tight, drawing the retaining ring and the sound emitter together.

In an alternate embodiment of the sound enhancing device which is used to enhance the performance of banjos, openable drums, and the like, the bridge is mounted inside the sound chamber. Compatible with the cylindrical wood rim which typically encloses the sound chamber in such instruments, the bridge is formed as a brass half-donut which has concentric, generally flat bottom edges for contacting the wood rim. Also defined by the half-donut is a reverse-tapered hole with a centerline which extends perpendicularly to the plane in which the concentric bottom edges lie.

In use, the concentric bottom edges of the bridge are pressed against the wood rim. The bridge is sized to have sufficient height or standoff to keep portions of the sound emitter which are contiguous thereto free of direct physical contact with the curved wood rim while the sound enhancing device is operating. Holding the bridge and the sound emitter together in assembled relation is the fastener which, in the alternate embodiment, includes a bolt or machine screw with threads which fit the banjo's (or drum's) existing "shoe" bracket. The bolt passes through both the reverse-tapered hole of the half-donut and the central hole of each of the cross-shaped elements and the timbre square. When the bolt is tightened by screwing it into the "shoe" bracket, the head of the bolt, which is positioned inwardly of the sound emitter, presses against it, drawing the nested cross-shaped elements, the timbre square, the half-donut, and the cylindrical wood rim together in assembled relation.

Common to both embodiments of the improved sound enhancing device is the sound emitter which receives surface waves, including those collected by the bridge, through a fastener slideably held within a central hole in each of the sound emitter's crossed-shaped elements and timbre squares. Sound waves are also transferred by direct physical contact to the sound emitter whenever one or its crossed-shaped elements or timbre squares touches vibration-active surfaces on the body of the musical instrument or the bridge itself.

As confirmed by testing, noticeable amplification of the instrument's sound results with the use of the improved sound enhancing device. Specifically, the volume was found to increase with every addition, at least up to a quantity of four, of a crossed-shaped element or timbre square to the sound emitter. Importantly, because of high frequency amplification, and the fact that the "pleasantness" of the sound depends upon the presence and high energy level in the first several harmonics, not only could one play the instrument louder but also it sounded better at all volume levels. While amplification was highly noticeable at all levels of playing effort, the sound increase was especially impressive when input energy was moderate to high, such as when the instrument was played vigorously.

These test results are consistent with the theory that in the sound emitter, surface sound waves radiate outwardly from the center of each cross-shape element and timbre square toward its outer edges. There, because of the difference in media density between the various materials in the sound emitter—primarily wood and metal—and air, the sound waves are reflected backwardly. In the process, they meet sound waves, with the same or similar frequencies, moving from different directions and set up patterns of constructive interference, causing amplification of the fundamental tones in the sound waves as well as their harmonics (frequency multiples).

In the preferred embodiment, each of the crossed shaped elements includes a generally flat central section and four three-sided arms which are formed integrally therewith. Contiguous arms in each cross-shaped element are disposed generally perpendicularly to each other, but only three of the arms have square edges. The remaining arm is preferably trapezoidal in shape.

In assembled relation, the generally flat central sections of the nested cross-shaped elements are in direct physical contact; but their respective arms, although they are paired in an orthogonal array, are spaced apart in such a way as to create small diverging air spaces which extend outwardly between the paired arms. Moreover, each of the arms is adjustable in position and, in use, is bent slightly so that its curvature differs substantially from that of the arm with which it is paired in the orthogonal array.

Transfer of surface sound waves from the sound emitter to the sound chamber's air occurs when their small motion in the diverging surfaces of the paired arms, as well as between an arm and a contiguous portion of the timbre square, compresses the air in the smallest spaces between these surfaces. In the case of nested cross-shaped elements, these air spaces range in size from zero where the contiguous center sections touch to approximately ⅛-inch or more at the outer extremities of the paired arms. The air compression creates audible sound in these smallest spaces; and the increasing amount of air space toward the outer edges of the paired arms, or alternately, an arm and a contiguous portion of the timbre square, due to their divergence, cause the sound in air to be amplified. In effect, the orthogonal array of paired arms in the nested cross-members amplifies sound in a manner analogous to that of four open-sided megaphones. Since the four sets of paired arms in the nested cross-shaped elements are disposed perpendicularly and are open on their sides, amplification in air also occurs between these open sides.

As found in practice, both the spacing between the paired arms of the nested cross-shaped elements and the arms' curvatures effect the quality and volume of instruments on which an improved sound enhancing device is mounted. When the sound emitter is mounted in a banjo, a player can easily change the spacing between the paired arms and their respective curvatures directly by hand, using only the sense of touch. For F-hole instruments, on the other hand, a simple tool is provided to help the player make these adjustments which are critical for optimizing the instrument's performance.

Not only is the instrument's timbre changed when sound surface waves move across the timbre square and cross-shaped elements of different materials but also the volume is affected. Preferably, the timbre square and cross-shaped elements included in the sound emitter are selected on the basis of the timbre and volume desired and are changed to meet different purposes. With the improved sound enhancing device, a wide variety of combinations using different materials and shapes (whether timbre squares or cross-shaped elembers) and also varying their order and the number of each in the sound emitter is possible.

Moreover, the timbre square and the cross-shaped element disposed contiguous thereto, in combination, comprise means for adjusting the sound duration of an instrument using the improved sound enhancing device. The sound duration is maximized whenever the timbre square is oriented generally diagonally with respect to the square shaped arms of the contiguous cross-shaped element.

In an alternate embodiment, provided to facilitate changing timbre in F-hole instruments, both the bridge and at least one cross-shaped element are mounted outside of the sound chamber. Very easily added without removing the sound emitter from the sound chamber, this externally mounted cross-shaped element greatly increases the volume as well as the timbre. Brightness and clarity are also increased if one or more of the cross-shaped element's arms is positioned over the F-hole. This brightness is further enhanced when a hole, preferably about ¼ inch in diameter is formed in each of the two opposing square-shaped arms of the elements; and these opposing arms are then positioned so that their holes are disposed over the F-hole,

DETAILED DESCRIPTION OF THE PREFERRED EMBODIMENTS

Figure 1:
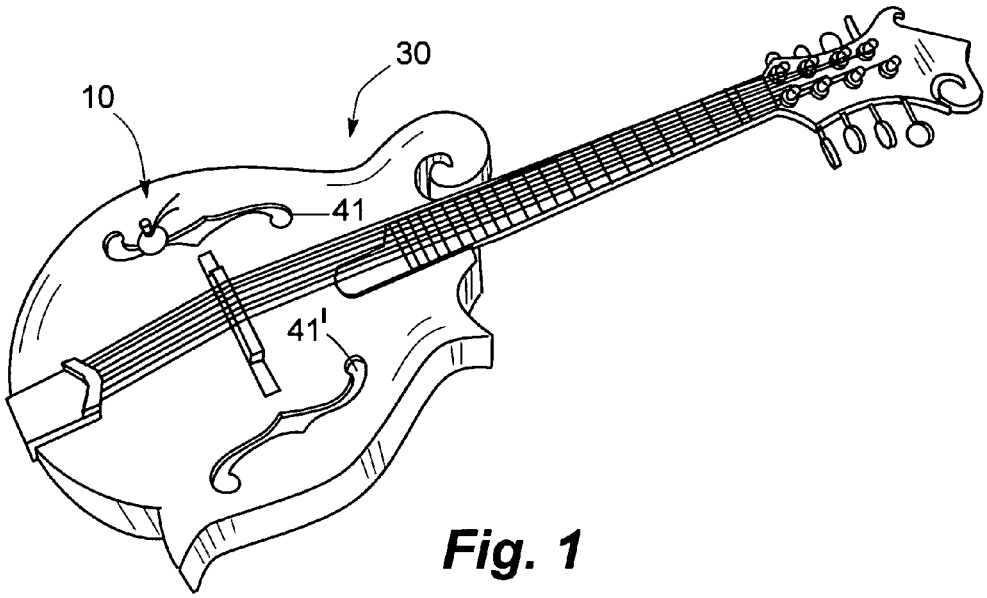
FIG. 1 is an outside perspective of a the invention of a sound enhancing device according to the present invention, the device being depicted with its half-ball bridge astraddle the F-hole sound opening of a conventional mandolin, the mandolin being shown for illustrative purposes only and forming no part of the claimed invention.

In the drawings, an improved sound enhancing device for use with a stringed instrument 30 having elongated sound openings 41, 41' is indicated generally by the reference numeral 10. The device 10 includes a sound emitter, a bridge 35 and a fastener which, in the first embodiment, is a waxed, knot-free string 20.

Constructed of thin metal and wood strips in a stacked array, the sound emitter comprises at least two nested cross-shaped elements 11, 21 and one or more timbre squares 31, which define central holes 16, 17, 18, respectively. Preferably, both the cross-shaped elements 11, 21 and the timbre square 31 are fabricated from metal or two-ply veneer wood.

Metal timbre squares 31 are typically thin carbon steel, which measures approximately 0.007-inch thick and 1-inch square, and brass squares of the same size but which measure approximately 0.010-inch in thickness. Wood veneer squares are typically made of maple or mahogany or glued combinations of these or similar woods. Cross-shaped elements 11, 21 are typically brass pieces of approximately 0.010-inch thickness and two-ply maple or mahogany veneer. Timbre is changed when sound surface waves move across timbre squares 31 and cross-shaped elements 11, 21 made of different materials.

Figure 2:
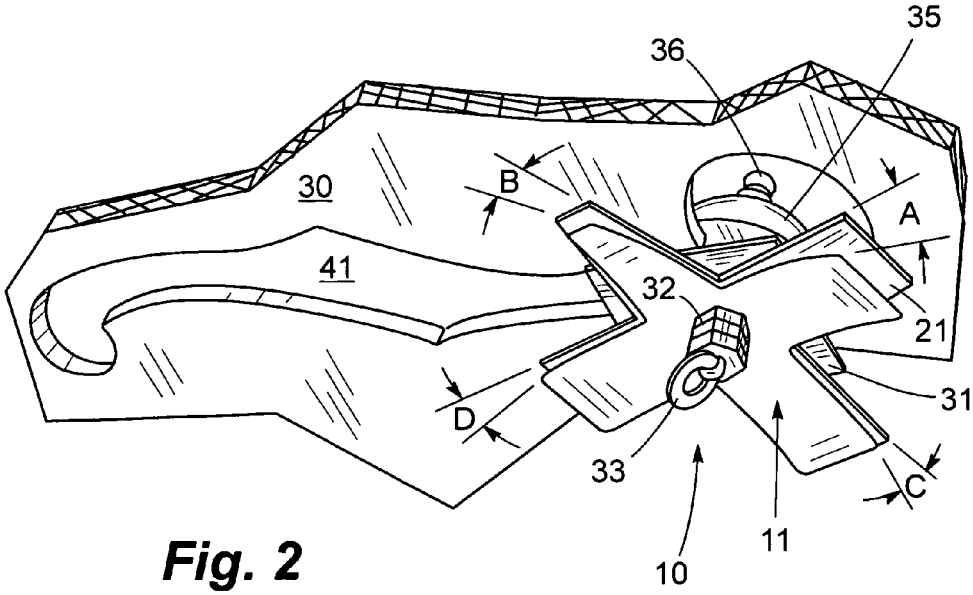
FIG. 2 is close up perspective view of the sound enhancing device according to FIG. 1 and a fragment of the mandolin, portions of the device which are mounted beneath the F-hole sound opening within the mandolin's sound chamber, as well as part of the half-ball bridge above it, being shown.

In operation, the sound emitter is mounted within the instrument's sound chamber beneath the sound opening 41 (FIG. 2). Aligned with the sound emitter along the string 20, the bridge 35, on the other hand, is mounted outside of the sound chamber.

Figure 6:
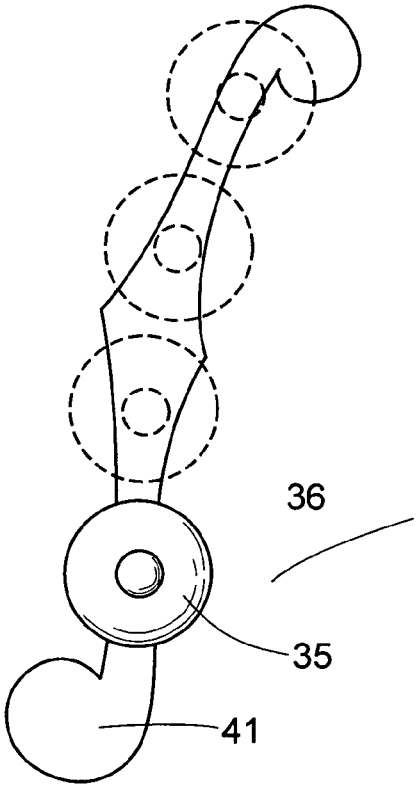
FIG. 6 shows schematically various positions along the length of an F-hole sound opening where one can mount the sound-enhancing device according to FIG. 1, the best sounding location for a particular musical instrument being selected experimentally by sliding the half-ball bridge along the sound opening.

Preferably formed as a wooden half-ball which has a generally flat bottom and defines a reverse-tapered hole 19 extending perpendicularly thereto, the bridge 35 is sized to straddle the sound opening 41. The bridge 35 collects a portion of the sound surface waves which typically move to and travel along F-hole edges. There the inaudible sound surface waves create active vibration centers which add their sound to the air as air with sound leaves the instrument's sound chamber through sound openings 41, 41'. Tests have shown that the amount of sound energy around F-hole edges varies considerably. As suggested in FIG. 6, the device 10 is designed to facilitate searches, along the length of an F-hole 41, for the best location to mount the bridge 35.

Figure 3:
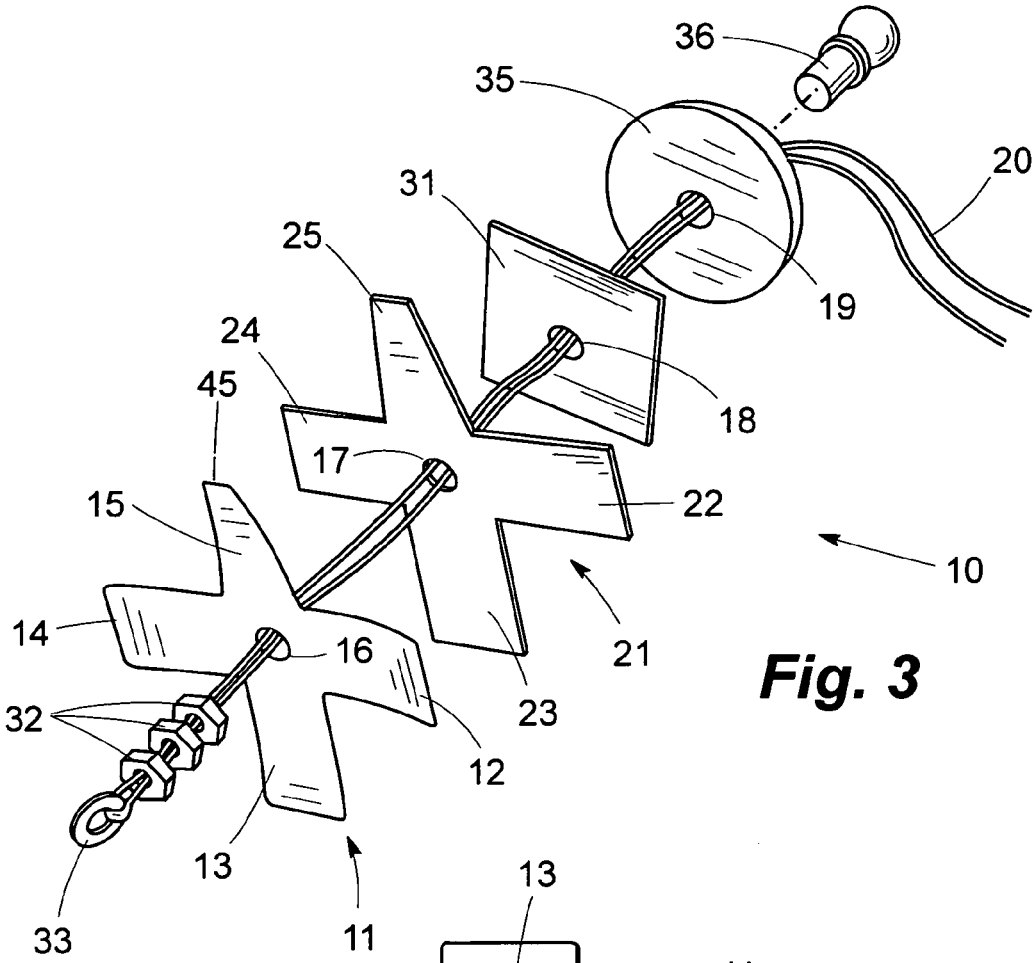
FIG. 3 is a exploded perspective view of the sound enhancing device according to FIG. 1.
Figure 5:
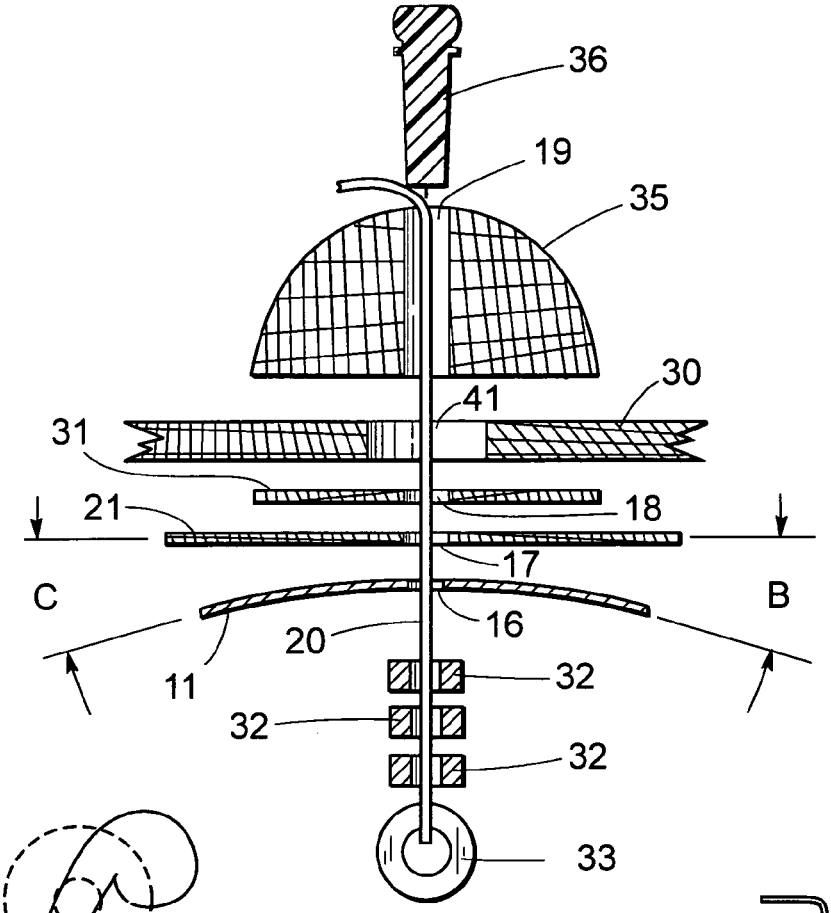
FIG. 5 is an exploded perspective view of the sound enhancing according to FIG. 1, portions of the device, as well as a fragment of the mandolin surrounding its F-hole sound opening, being shown in cross-section.

In use, opposing edges of the sound opening are wedged between the bridge's flat bottom and the sound emitter. Holding them together in assembled relation is the waxed string 20, a terminal retaining ring 33, and a tapered pin 36 (FIGS. 3 and 5). The pin 36 fits tightly in the smallest transverse cross-section of the reverse-tapered hole 19. So fitted, the pin 36 does not protrude from the bridge's flat bottom. Doubled upon itself except where it contacts the ring 33, the waxed string 20, which preferably measures about 1/32-inch in thickness, passes through both the reverse-tapered hole 19 and the central holes 16, 17, 18, as well as through openings in threadless brass nut spacers 32. The brass fittings 32, 33 help to reduce damping effects of the string 20 on the sound emitter.

Seated in the reverse-tapered hole 19, the pin 36 is used to hold a length of the doubled waxed string 20 securely against the hole's upper edge at the top of the half-ball once the string 20 has been pulled tight, drawing the retaining ring 33 and the sound emitter together.

Under tension, the waxed string 20, an unusual but efficient medium for sound waves, performs three functions in the device 10: (1) it holds the sound emitter securely against the bottom surface of the instrument's top; (2) it serves as the medium for sound surface waves between the half-ball and the sound emitter; (3) it provides necessary flexibility so that the sound emitter can be inserted into the elongated sound opening 41, one component at a time, and allows the sound emitter to be "self-constructed" as the various pieces of the sound emitter are drawn together when the string 20 is pulled taut.

The excellent acoustic efficiency of the waxed string 20 is also evident in the noticeable change in timbre which can be achieved by using different materials, such as rosewood, ebony, and plastic, for the pin 36. Because of the remote location of the pin 36 relative to the sound emitter, this timbre effect, which is dependent upon the presence of high frequency sounds passing over and/or through the pin 36, most likely enters the instrument's sound through the string 20 and is then transferred to the sound emitter in the sound chamber. Conversely, sound also travels from the sound emitter to the pin 36 where the half-ball/pin combination detects these sounds and broadcasts them to the instrument's top.

Not only does sound move to and from the sound emitter through the string 20 but also directly through the timbre square 31 where it touches the bottom surface of the instrument's top and where the cross-shaped elements 11, 21 and the timbre square 31 touch each other.

Because of the very short distance involved and the fast speed of sound through and over brass and hardwood materials, sound on the string 20 enters all wood and metal components strung thereon at almost the same time and is amplified, throughout surfaces in the sound emitter, where surface sound waves with similar frequencies meet.

The sound emitter not only amplifies the sound surface waves in the cross-shaped elements 11, 21 and timbre square 31 by constructive interference but also adds timbre characteristics and transfers these waves into the air of the sound chamber. The amplified sound in air in the chamber further increases the sound surface waves at the sound hole edges which are again sent back to the sound emitter for amplification in the manner of positive feedback. Because the device 10 is made to respond efficiently to high frequencies, primarily through the use of thin geometries and very short distances, harmonics are amplified, improving sound quality. The positive feedback effect also increases sound duration unless the latter is reduced by using softer materials in the components, or alternately fewer components, in the sound emitter.

Much of the uniqueness of the F-hole embodiment revolves around the ease with which a player can construct and then modify the device 10 to achieve different timbres and volumes. The flexible string 20 allows the sound emitter is be easily inserted, withdrawn and also "self-constructed" in the sound chamber immediately beneath the F-hole opening 41 when the string 20 is pulled tight.

Figure 7:
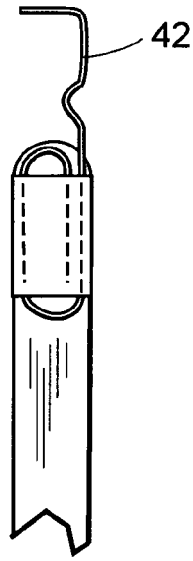
FIG. 7 is a plan view of a tool which can be used to install the sound emitter of the sound enhancing device according to FIG. 1 within the sound chamber of an instrument having an F-hole opening.
Figure 8:
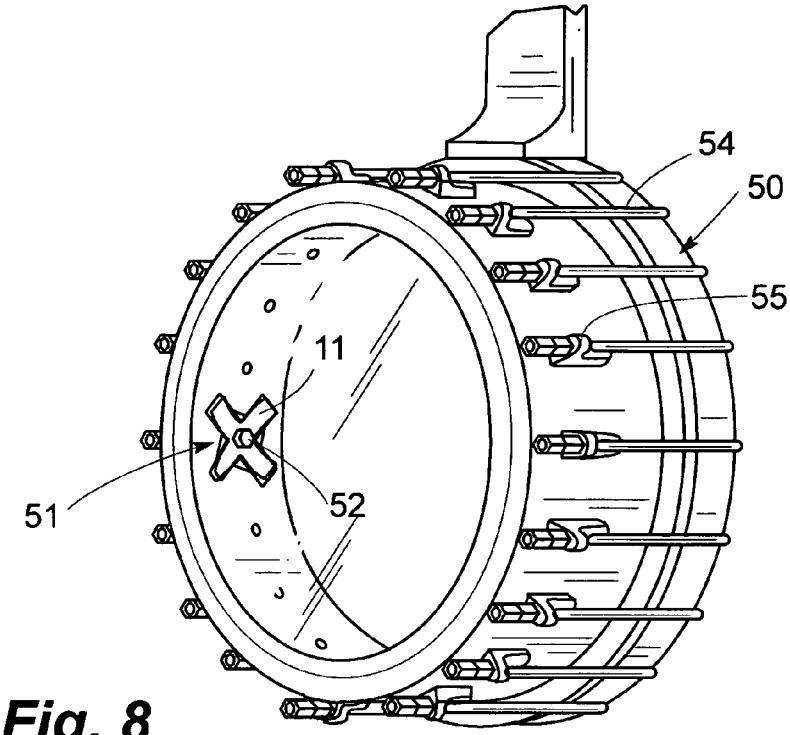
FIGS. 8 and 9 are perspective and exploded views, respectively, of an alternate embodiment of the sound enhancing device according to FIG. 1 which is mountable inside a banjo's sound chamber, the fragmentary portions of the banjo depicted in FIGS. 8 and 9 being shown for illustrative purposes only and forming no part of the invention.
Figure 9:
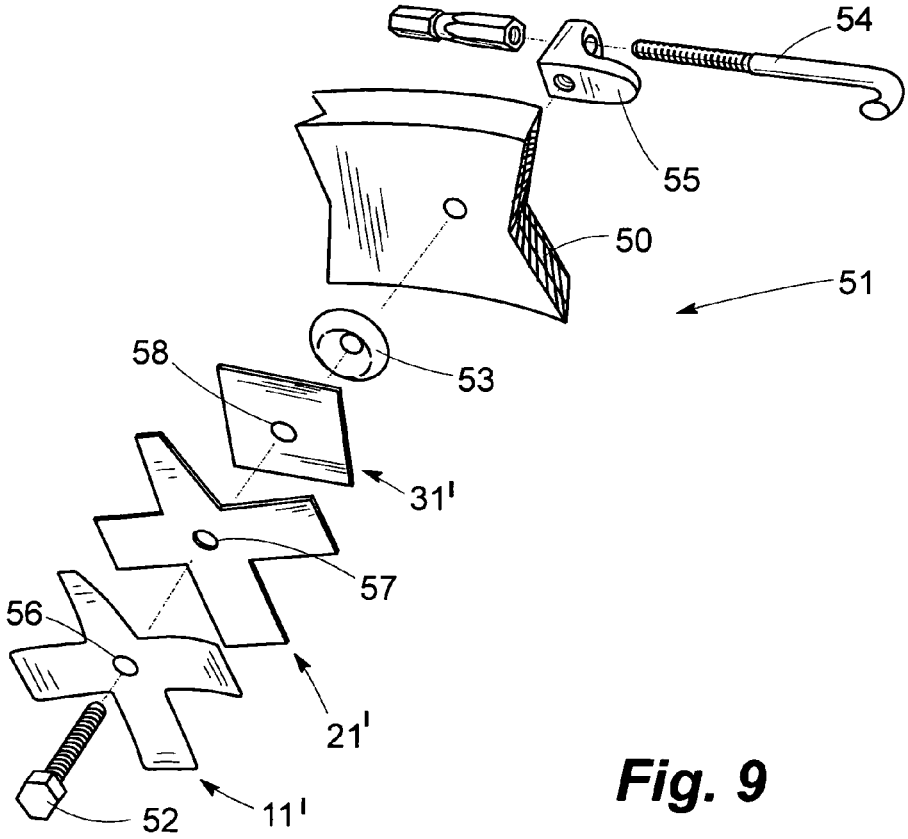
Figure 10:
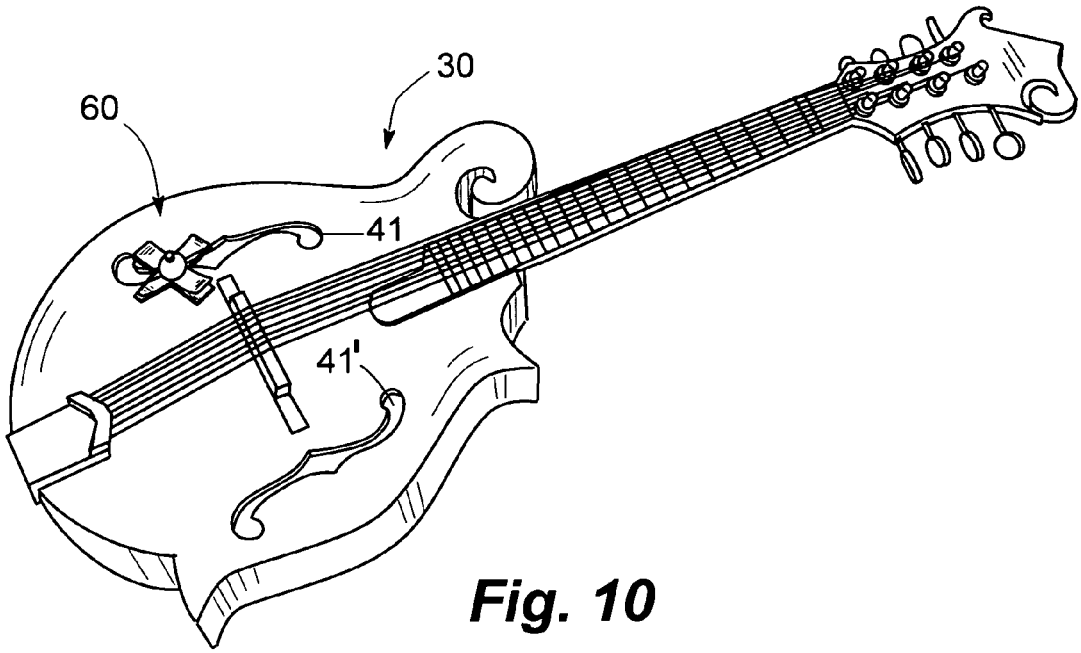
FIGS. 10 and 11 are outside and closeup inside perspective views, respectively, of a further alternate embodiment of the sound enhancing device according to FIG. 1, the device being depicted with its half-ball bridge and a cross-shaped element contiguous thereto astraddle the F-hole sound opening of a conventional mandolin, the mandolin being shown for illustrative purposes only and forming no part of the claimed invention.
Figure 11:
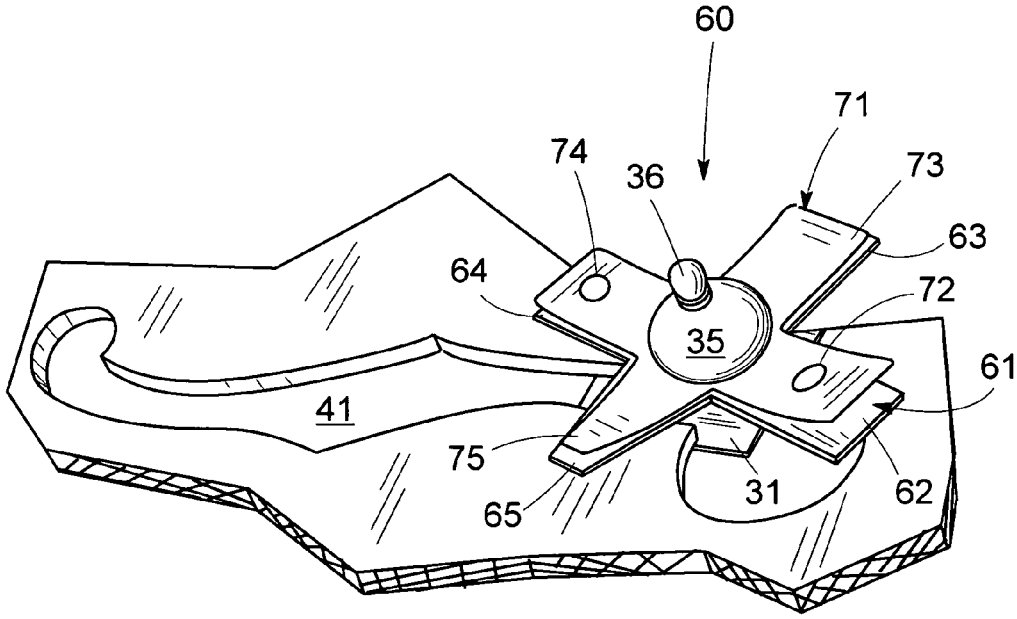

Illustrated in FIG. 7 is a simple tool 42 which can be used to facilitate insertion and removal of the device 10 through the F-hole 41. The player first constructs the device 10 in loose form by threading desired components including cross-shaped elements 11, 21 and timbre square 31 on the string 20. Since the components are either small or almost flat, they can be placed sideways through the sound opening 41, one component at a time.

When all the components, except for the bridge 30, which are to be strung on the string 20 are hanging from it in the sound chamber, the player then presses the bridge half-ball down on the instrument's top and pulls the string taut (but not tight). Because the string 20 is, at this point, not very tight, the half-ball bridge 30 can be slid along the length of the F-hole 41, while one intermittently picks the strings, to find the most responsive location for the device 10. Once the best sounding location is found, the pin 36 is temporarily loosened, allowing the string 20 to be pulled very tight; and then the pin 36 is seated to secure it.

Figure 4:
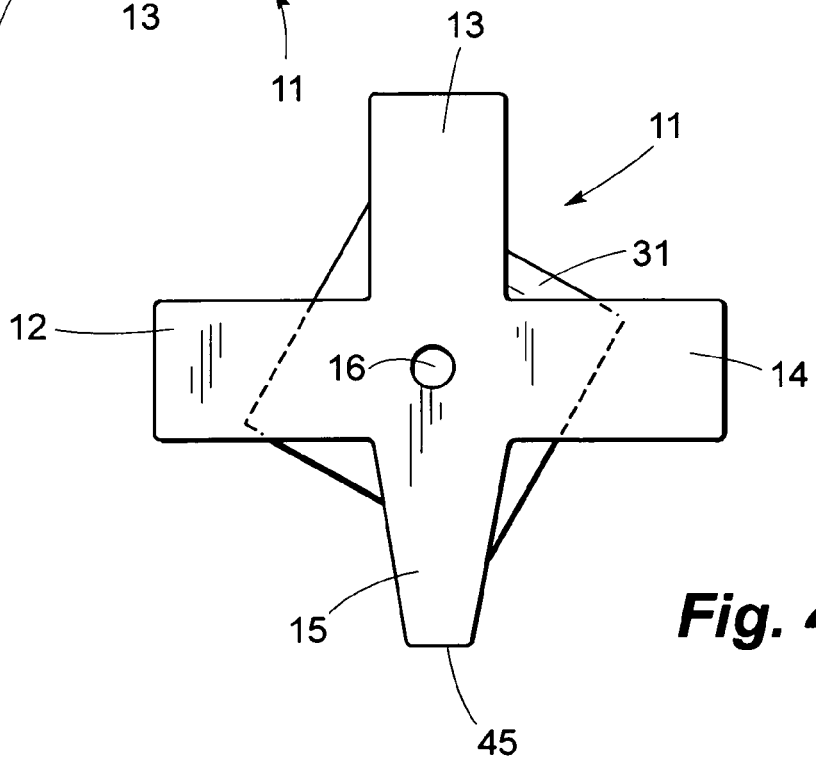
FIG. 4 is a plan view of the cross-shaped element and a timbre square, components which individual players can use in constructing the sound emitter device according to FIG. 1, an alignment of its timbre square with the cross-shaped element in which maximum sound duration is achieved being shown.

The tool 42 is next used to align the paired arms in an orthogonal array of the nested cross-shaped members 11, 21. The tool is also used to orient the timbre square 31, which is mounted contiguous with the bottom surface of the instrument's top, relative to the cross-shaped elements 11, 21 (FIGS. 2 and 4). The relative angle between the timbre square 31 and the cross-shaped elements 11, 21 determines the amount of sustained sound duration. As is done to find the best sounding location in the F-hole 41, one can determine this relative angle by intermittent playing of the instrument 30 between changes in the angle. So that adjustments can be made without loosening the string 20, the tool 42 includes a vinyl-coated hook for "pulling" a cross-shaped element to a different angle. And an indented portion or notch formed on the hook can be used to "push" either the timbre square 31 or the element 11, 21.

In addition, the tool 42 can be utilized to further adjust the sound quality of the instrument 30, when the sound emitter is mounted in its sound chamber, by bending the paired arms 12, 22: 13, 23: 14, 24: 15. 25 so as to change the angles A, C, D, B between them, respectively.

In the second embodiment, a sound enhancing device 51 is provided for use with a banjo 50 or similar instruments such as openable drums. The device 51 employs a bolt 52 instead of the string 20 to mount both the sound emitter and a bridge 53 within the banjo's sound chamber in such a way that the bridge physically contacts the instrument's wood rim.

Preferably, one of the original bolts for engaging one of the banjo's existing "shoes" 55 used to hold a hook 56 (for securing the banjo's top) is replaced. Made of either steel or brass, the replacement 52 has the same diameter and thread but is slightly greater in length, by about 3/16 inch, than the original bolt. Moreover, central mounting holes 56, 57, 58 in the cross-shaped elements 11'. 21' and timbre square 31' and the opening in the bridge 53, which is preferably a brass (or alternately, steel) finishing washer, are sized to receive the bolt 52.

The metallic finishing washer 53 serves as a highly efficient circular vibration transfer bridge, giving excellent sound quality, and is used in part to standoff the sound emitter from the inside wall of the banjo 50. In operation, the bridge washer 53 brings "wooden" sounds from the inside surface of the banjo's wood rim to the back side of the sound emitter, while the head of the bolt 52 brings "metallic" sounds from the "shoe" 55 to the front side of the sound emitter.

In a third embodiment, an improved sound enhancing device 60 is provided to facilitate changing timbre in F-hole instruments 30. Both the bridge 35 and nested cross-shaped elements 61, 71 are mounted outside of the sound chamber. Very easily added without removing the timbre square 31 from the sound chamber, externally mounted cross-shaped elements 61, 71 and their paired arms 62, 72; 63, 73; 64, 74; 65, 75 greatly increase the volume as well as affecting the timbre. Brightness and clarity are also increased if at least one set of paired arms is positioned over the F-hole. This brightness is further enhanced when a hole, preferably about ¼ inch in diameter, is formed in each of the two opposing square shaped arms 72, 74 in the outermost cross-shaped element 71; and these opposing arms are then positioned so that their holes are disposed over the F-hole 41 in use.

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the embodiment may be varied without departing from the spirit of the invention, and the exclusive use of all modifications which come within the scope of the appended claims is reserved.

What is claimed is:

1. A sound-enhancing device adapted for use with stringed instruments having a body which defines a sound chamber and an elongated sound opening with opposing side edges, which comprises:

(a) an elongated fastener including a terminal retainer;

(b) a first cross-shaped element and a bridge, the cross-shaped element and the bridge each defining a central hole for slideably receiving the elongated fastener; the cross-shaped element and the bridge, in assembled relation, being aligned longitudinally along the fastener; the bridge during use, straddling the opposing side edges of the sound opening and partially covering the sound chamber; and (c) means for tensioning the fastener when the cross-shaped element and the bridge are mounted within and above the sound chamber, respectively, in such a way that when the fastener is tensioned, the terminal retainer is pulled toward the cross-shaped element, sandwiching the opposing edges of the sound opening between the cross-shaped element and the bridge.

2. The sound-enhancing device according to claim 1, wherein the elongated fastener comprises a knot-free, waxed string and the means for tensioning the fastener includes a tapered pin, the bridge being further characterized as having a generally flat bottom and a half-ball shape, the bridge's central hole having a reverse taper and extending perpendicularly to the flat bottom, the pin fitting tightly in the reverse-tapered hole, the waxed string, which is doubled upon itself except where it contacts the terminal retainer, passing through both the reverse-tapered hole and the central hole of the cross-shaped element; and the pin, when seated in the reverse-tapered hole, holding a portion of the doubled waxed string securely against the reverse-tapered hole's upper edge, once the string is pulled tight.

3. The sound-enhancing device according to claim 1, wherein the cross-shaped element is further characterized as having a central section and four arms formed integrally therewith as a single, unitary piece; the four arms extending outwardly from a central section in which is defined the central hole; each arm having three side edges which, in one of the arms, are generally trapezoidal in shape, the three side edges of the remaining three arms being generally square shaped.

4. The sound-enhancing device according to claim 3, which further comprises a second cross-shaped element, the first and second cross-shaped elements being a nested pair, the central sections of both crossed-shaped elements being generally flat so that contiguous central sections in assembled relation touch; the arms of the first and second cross-shaped elements being adjustable in position and having curvatures which differ substantially so that when the first and second cross-shaped elements are nested together with their arms aligned in an orthogonal array, the distal ends of each contiguous pair of arms are spaced apart, creating diverging air spaces which extend outwardly between the paired arms, from their respective central sections.

5. The sound-enhancing device according to claim 1 which further comprises a timbre square, the timbre square defining a central hole for slideably receiving the elongated fastener; the cross-shaped element, the timbre square and the bridge, in assembled relation, being aligned longitudinally along the fastener; the timbre square being juxtaposed between the cross-shaped element and the opposing edges of the sound opening whenever the fastener is tensioned so as to pull the terminal retainer toward the cross-shaped element.

6. The sound enhancing device according to claim 5, which further comprises means for adjusting the instrument's sound duration and wherein the cross-shaped element is further characterized as having a central section and four arms formed integrally therewith as a single, unitary piece; the four arms extending outwardly from the central section in which is defined the central hole; each arm having three side edges which, in one of the arms, are generally trapezoidal in shape, the three side edges of the remaining three arms being generally square shaped; the means for adjusting the instrument's sound including the timbre square and the cross-shaped element being disposed contiguous thereto, with the sound duration being maximized whenever the timbre square is oriented generally diagonally with respect to the square shaped arms of the cross-shaped element.

7. A sound-enhancing device adapted for use with musical instruments having a body which defines a sound chamber, at least a portion of the instrument's body being fabricated of wood, which comprises:

(a) an elongated fastener including a terminal retainer;

(b) a first cross-shaped element and a bridge, the cross shaped element and the bridge each defining a central hole for slideably receiving the elongated fastener; the cross-shaped element and the bridge, in assembled relation, being aligned longitudinally along the fastener, with the cross-shaped element being mounted within the sound chamber, the bridge, during use, contracting the wood portion of the body; and (c) means for tensioning the fastener in such away that both the terminal retainer and the bridge are pulled toward the wood portion of the body with the cross-shaped element being sandwiched between the terminal retainer and the bridge.

8. The sound-enhancing device according to claim 7 which further comprises a timbre square, the timbre square defining a central hole for slideably receiving the elongated fastener; the cross-shaped element, the timbre square and the bridge, in assembled relation, being aligned longitudinally along the fastener; the timbre square being juxtaposed between the cross-shaped element and the opposing edges of the sound opening whenever the fastener is tensioned so as to pull the terminal retainer toward the cross-shaped element.

9. The sound-enhancing device according to claim 8 wherein the bridge is further characterized as being fabricated of metal and having a half-donut shape with generally flat bottom edges for contracting the wood portion of the body; the bridge is sized to have sufficient height to keep the timbre square and the cross-shaped element contiguous thereto free of direct physical contact with the wood portion of the body while the sound enhancing device is operating.

10. The sound enhancing device according to claim 8, which further comprises means for adjusting the instrument's sound duration and wherein the cross-shaped element is further characterized as having a central section and four arms formed integrally therewith as a single, unitary piece; the four arms extending outwardly from the central section in which is defined the central hole; each arm having three side edges which, in one of the arms, are generally trapezoidal in shape, the three side edges of the remaining three arms being generally square shaped; the means for adjusting the instrument's sound including the timbre square and the cross-shaped element being disposed contiguous thereto, with the sound duration being maximized whenever the timbre square is oriented generally diagonally with respect to the square shaped arms of the cross-shaped element.

11. The sound-enhancing device according to claim 7, which further comprises a second cross-shaped element, the first and second cross-shaped elements being a nested pair, the central sections of both crossed-shaped elements being generally flat so that contiguous central sections, in assembled relation, touch; the arms of the first and second cross-shaped elements being adjustable in position and having curvatures which differ substantially so that when the first and second cross-shaped elements are nested together with their arms aligned in an orthogonal array, the distal ends of each contiguous pair of arms are spaced apart, creating diverging air spaces which extend outwardly between the paired arms, from their respective central sections.

12. A sound-enhancing device adapted for use with musical instruments having a body which defines a sound chamber, at least a portion of the instrument's body being fabricated of wood, which comprises:

(a) an elongated fastener including a terminal retainer;

(b) a first cross-shaped element, a timbre square and a bridge; the cross-shaped element, the timbre square and the bridge each defining a central hole for slideably receiving the elongated fastener; the cross-shaped element, the timbre square and the bridge, in assembled relation, being aligned longitudinally along the fastener; and (c) means for tensioning the fastener in such a way that both the terminal retainer and the bridge are pulled toward the wood portion of the body with the cross-shaped element and the timbre square being sandwiched between the terminal retainer and the bridge in use.

13. The sound-enhancing device according to claim 12, wherein both the cross-shaped element and the timbre square are mounted inside of the sound chamber; the bridge and the timbre square, during use, contacting the wood portion of the body.

14. The sound-enhancing device according to claim 12, wherein both the cross-shaped element and the bridge are mounted outside of the sound chamber; both the cross-shaped element and the timbre square, during use, contacting the wood portion of the body.

* * * * *